US007369802B2

(12) United States Patent
Cho et al.

(10) Patent No.: US 7,369,802 B2
(45) Date of Patent: May 6, 2008

(54) FUSING ROLLER WITH ADJUSTABLE HEATING AREA AND FUSING APPARATUS USING THE SAME

(75) Inventors: Durk-hyun Cho, Suwon-si (KR); Sang-yong Han, Suwon-si (KR); Joong-gi Kwon, Gunpo-si (KR); Hwan-guem Kim, Seoul (KR); Young-min Chae, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 292 days.

(21) Appl. No.: 11/178,296

(22) Filed: Jul. 12, 2005

(65) Prior Publication Data

US 2006/0045587 A1 Mar. 2, 2006

(30) Foreign Application Priority Data

Aug. 25, 2004 (KR) ..... 10-2004-0067088

(51) Int. Cl.
*G03G 15/20* (2006.01)

(52) U.S. Cl. ..... 399/328; 219/619; 399/69

(58) Field of Classification Search ..... 219/619, 219/636, 632, 677, 216; 399/69, 328
See application file for complete search history.

(56) References Cited

U.S. PATENT DOCUMENTS

| | | | | |
|---|---|---|---|---|
| 6,246,843 | B1 | 6/2001 | Nanataki et al. | |
| 7,038,178 | B2 * | 5/2006 | Suzuki | 399/328 |
| 2004/0129697 | A1 | 7/2004 | Suzki | |

FOREIGN PATENT DOCUMENTS

| | | |
|---|---|---|
| JP | 57-202576 | 12/1982 |

OTHER PUBLICATIONS

Notice to Submit Response issued by the Korean Intellectual Property Office in Application No. 10-2004-0067088 dated Dec. 16, 2005.

First Office Action issued on Nov. 16, 2007 in the corresponding Chinese Patent Application No. 200510097736.6 (7 pages) (English Translation of First Office Action consisting of 8 pages).

* cited by examiner

*Primary Examiner*—Susan Lee
(74) *Attorney, Agent, or Firm*—Staas & Halsey LLP

(57) ABSTRACT

A fusing roller and a fusing apparatus having the same are provided. The fusing roller includes: an induced coil, which generates an alternating magnetic flux that varies depending on an input alternating current; a heating roller, which is heated by an eddy current that is generated by the alternating magnetic flux; and a compensator, which compensates for the eddy current generated where it is located.

22 Claims, 5 Drawing Sheets

FUSING ROLLER WITH ADJUSTABLE HEATING AREA AND FUSING APPARATUS USING THE SAME

CROSS REFERENCE TO RELATED APPLICATION

This application claims the benefit of Korean Patent Application No. 10-2004-0067088, filed on Aug. 25, 2004, in the Korean Intellectual Property Office, the disclosure of which is incorporated herein in its entirety by reference.

1. Field of the Invention

The present invention relates to a fusing apparatus and, more particularly, to a fusing apparatus having a fusing roller, which can adjust the area of a heated portion based on the size of a recording medium so that heat can only be applied to the recording medium.

2. Description of the Related Art

In general, electrophotographic image forming apparatuses, such as laser printers or digital copiers, print a unicolored or multicolored image by applying light to a photosensitive medium charged with a predetermined potential to form a latent electrostatic image on the photosensitive medium, enabling a developer to develop the latent electrostatic image with a predetermined color of toner, transferring the developed toner image to printing paper, and then fusing the transferred image onto the printing paper.

Electrophotographic printing apparatuses are classified into either wet-type electrophotographic printing apparatuses or dry-type electrophotographic printing apparatuses according to the type of developing agent that they use. Wet-type electrophotographic printing apparatuses use a developing agent in which toner particles are diffused into a liquid carrier, whereas dry-type electrophotographic printing apparatuses use a homogenous developing agent, which is composed of toner particles, or a heterogeneous developing agent, which is a mixture of carrier particles and toner particles.

FIG. 1 is a latitudinal cross-sectional view schematically illustrating a conventional fusing apparatus 10 using a halogen lamp as a heat source, and FIG. 2 is a longitudinal cross-sectional of the conventional fusing apparatus of FIG. 1, taken along line I-I' of FIG. 1. Referring to FIGS. 1 and 2, the fusing apparatus 10 includes two fusing rollers 11 and 12, which are formed of aluminum as cylinders. Both ends of each of the fusing rollers 11 and 12 are supported by bearings 14, and the fusing rollers 11 and 12 are installed to come in contact with each other along longitudinal directions thereof. A coat layer 13 is formed on the surface of each of the fusing rollers 11 and 12. The coat layer 13 forms a nip, via which heat is transferred from each of the fusing rollers 11 and 12 to a toner image 21 on a recording medium 20, and helps each of the fusing rollers 11 and 12 to be easily detached from the toner image 21 fused onto the recording medium 20.

A heating portion 15 is installed at the center of each of the fusing rollers 11 and 12 and uses, as a heat source, a halogen lamp that emits heat when connected to an external power supply (not shown). The heating portion 15 is separated from the inner surface of each of the fusing rollers 11 and 12 with an empty space therebetween filled with air.

When a current supplied by the external power supply is applied to both ends of the heating portion 15, the heating portion 15 generates radiant energy. The radiant energy is transmitted to the inner surface of each of the fusing rollers 11 and 12 via air and then converted into thermal energy passing through a light-heat conversion layer, which is formed of a black body. Then, the thermal energy is conducted to the nip, which is an interface between the fusing rollers 11 and 12, via the fusing rollers 11 and 12 and the coat layer 13, and is transmitted to the toner image 21 on the recording medium 20 so that the toner image 21 can be fused onto the recording medium 20 by the thermal energy.

However, the conventional fusing apparatus using a halogen lamp as a heat source has the following disadvantages.

First, since a halogen lamp has a low thermal efficiency, a considerable amount of time is required for warming the halogen lamp up until the temperature of the halogen lamp reaches a desired fusing temperature. Therefore, a user has to wait until the halogen lamp is heated to the desired fusing temperature and the conventional fusing apparatus becomes ready to print documents.

Second, since the halogen lamp is separated from the inner surface of each of the fusing rollers 11 and 12 with the empty space therebetween filled with air, heat emitted from the halogen lamp heats each of the fusing rollers 11 and 12 through radiation and passes through the fusing rollers 11 and 12 through conduction. Therefore, the speed of transmitting heat from the halogen lamp to the fusing rollers 11 and 12 is relatively low. In addition, the heat emitted from the halogen lamp is also transmitted to the recording medium 20, thereby causing differences in temperatures between portions of the recording medium 20 where the toner image 20 is formed and other portions of the recording medium 20 where no toner image is formed. However, it takes the conventional fusing apparatus a while to compensate for the temperature differences, and thus, it is difficult to achieve an even distribution of temperatures over the recording medium 20.

Third, in order to achieve a smooth transition from one printing operation to another printing operation, the conventional fusing apparatus consumes a considerable amount of power consecutively supplying a current to the heating portion and uniformly maintaining the temperature of the fusing rollers 11 and 12.

Finally, since the conventional fusing apparatus applies heat to a predetermined area of a region, regardless of the size of the recording medium 20, elements of the conventional fusing apparatus that do not directly engage with the recording medium 20 may be unnecessarily heated, which results in the deformation or breakdown of the corresponding elements of the conventional fusing apparatus.

SUMMARY OF THE INVENTION

Additional aspects and/or advantages of the invention will be set forth in part in the description which follows and, in part, will be apparent from the description, or may be learned by practice of the invention.

The present invention provides a fusing apparatus used with an image forming apparatus, which can reduce the time required for warming a heat source up by quickly increasing the temperature of the heat source to a desired fusing temperature using both resistive heat and induced heat and can adjust the area of a heated portion based on the size of a recording medium.

According to an aspect of the present invention, there is provided a fusing roller. The fusing roller includes: an induced coil, which generates an alternating magnetic flux that varies depending on an input alternating current; a heating roller, which is heated by an eddy current that is generated by the alternating magnetic flux; and a compensator, which compensates for the eddy current generated where it is located.

According to another aspect of the present invention, there is provided a fusing apparatus. The fusing apparatus includes: a fusing roller, which generates heat to fuse a toner image onto a recording medium; and a press roller, which is installed to face the fusing roller and presses the recording medium down on the fusing roller. Here, the fusing roller includes: an induced coil, which generates an alternating magnetic flux that varies depending on an input alternating current; a heating roller, which is heated by an eddy current that is generated by the alternating magnetic flux; and a compensator, which compensates for the eddy current generated where it is located.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE PREFERRED EMBODIMENTS

Figure 1:
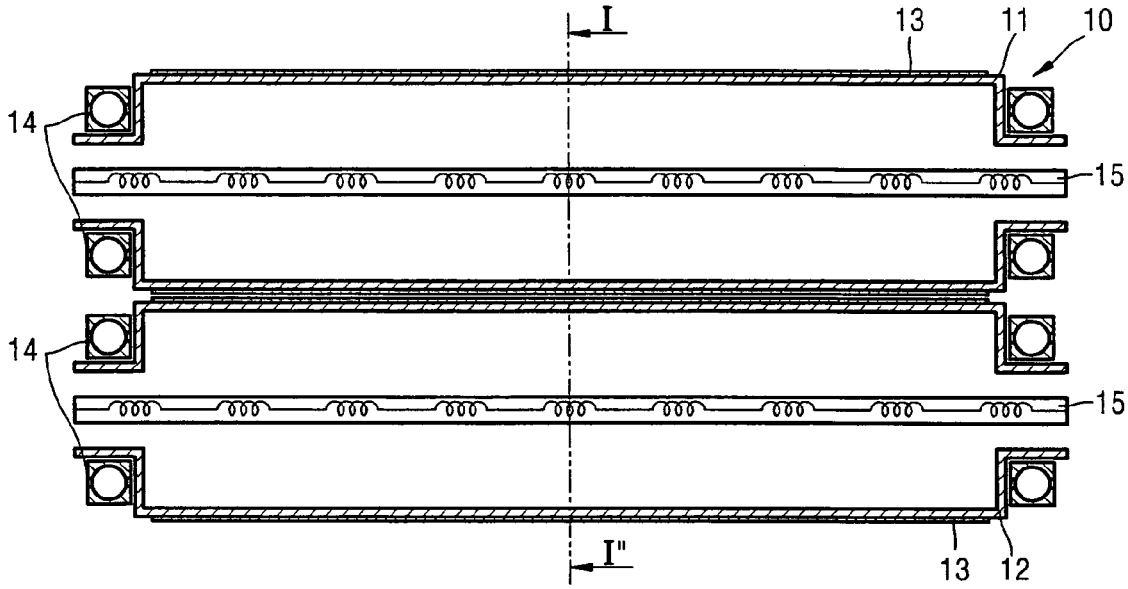
FIG. 1 (PRIOR ART)
FIG. 1 is a latitudinal cross-sectional view of a conventional fusing apparatus using a halogen lamp as a heat source.
Figure 2:
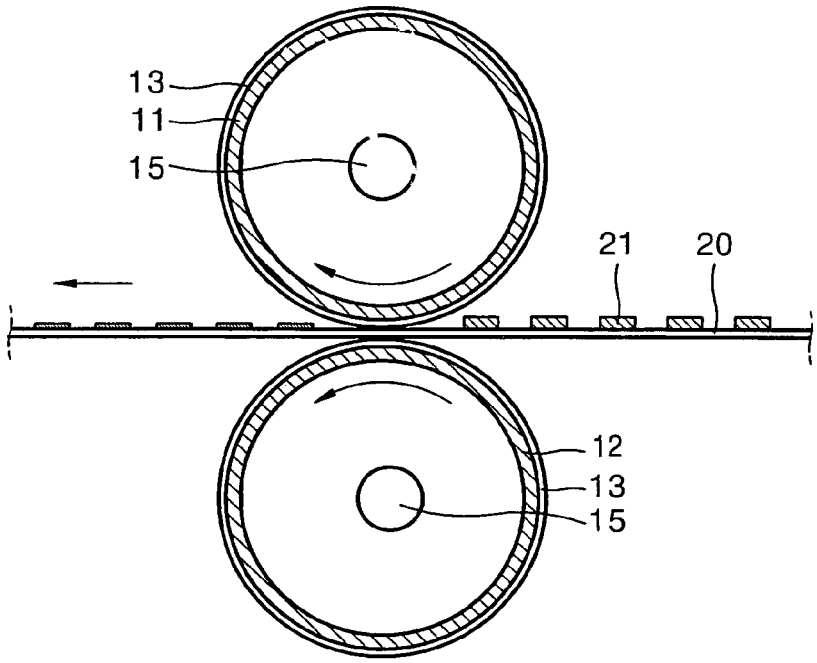
FIG. 2 (PRIOR ART)
FIG. 2 is a longitudinal cross-sectional view of the conventional fusing apparatus of FIG. 1, taken along line I-I' of FIG. 1.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 3:
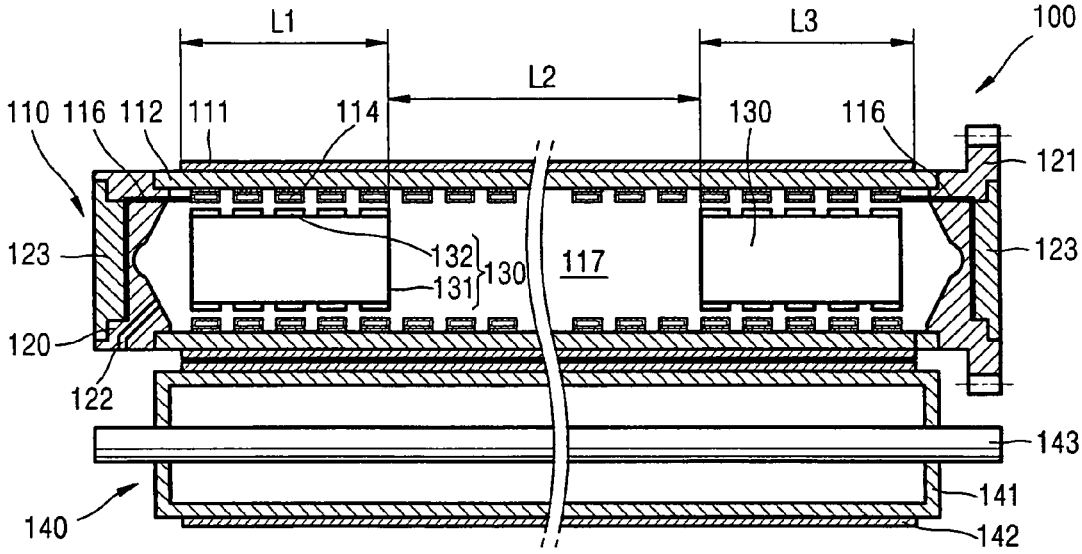
FIG. 3 is a latitudinal cross-sectional view of a fusing apparatus, in which a fusing roller according to an exemplary embodiment of the present invention is installed.
Figure 4:
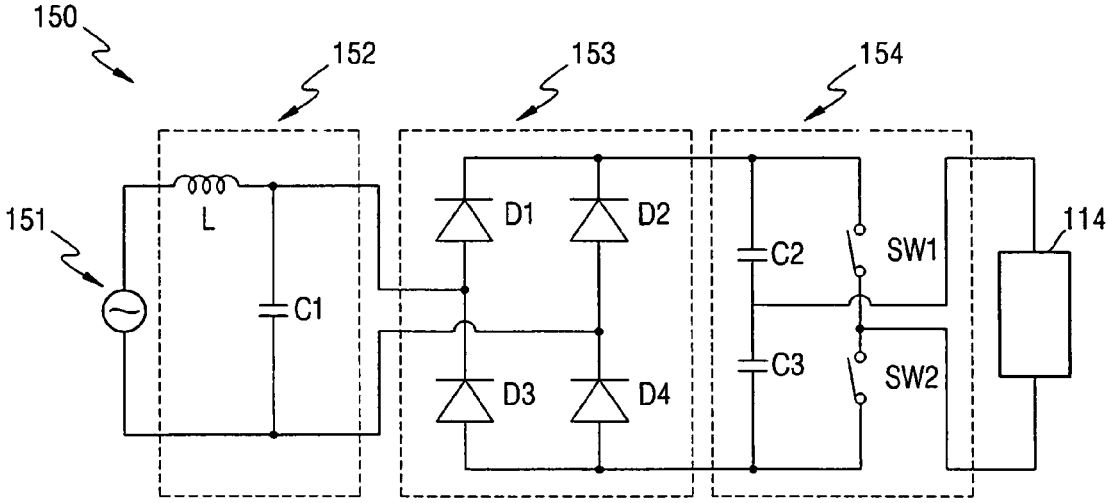
FIG. 4 is a circuit diagram of a power supply of the fusing roller of FIG. 3.
Figure 5:
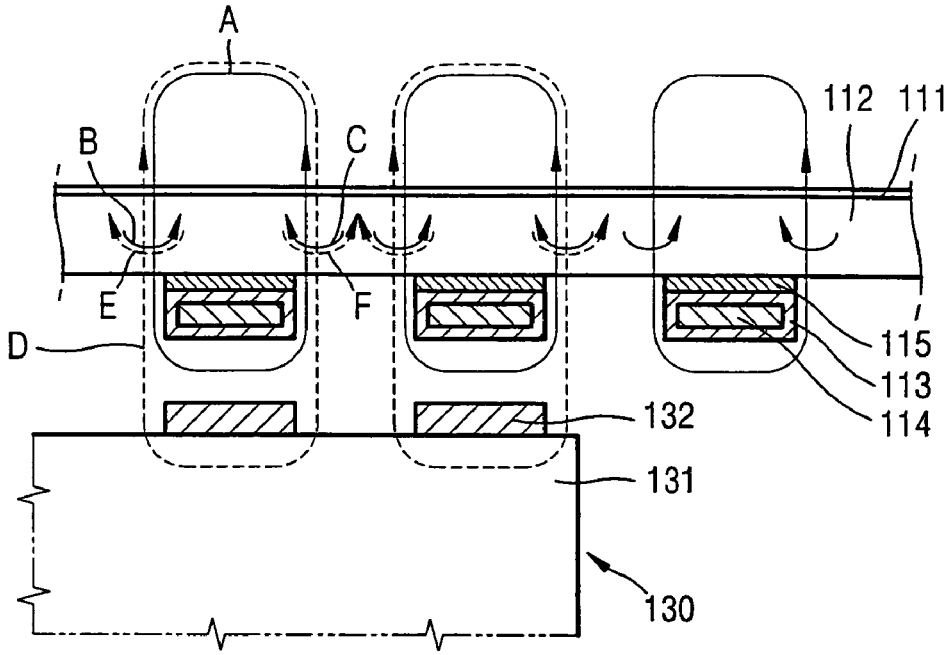
FIG. 5 is a diagram illustrating the operation of a compensator of the fusing roller of FIG. 3.
Figure 6:
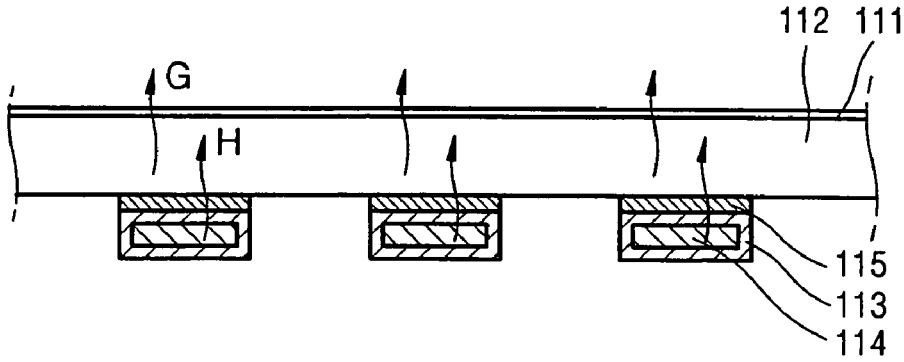
FIG. 6 is a diagram illustrating a heat source of the fusing roller of FIG. 3.

FIG. 3 is a latitudinal cross-sectional view of a fusing apparatus 100, in which a fusing roller 110 according to an exemplary embodiment of the present invention is installed. FIG. 4 is a circuit diagram of a power supply for the fusing roller 110. FIG. 5 is a diagram illustrating the operation of a compensator of the fusing roller 110. FIG. 6 is a diagram illustrating a heat source of the fusing roller 110.

Referring to FIGS. 3 and 4, a fusing apparatus 100 includes the fusing roller 110, which generates heat that fuses a toner image (not shown) on to a recording medium (not shown), and a press roller 140, which is installed to contact the fusing roller 110 along a longitudinal direction thereof and presses the recording medium down on the fusing roller 110. Here, the recording medium passes through a nip between the fusing roller 110 and the press roller 140.

The press roller 140 is supported by an axial member 143 so that a body 141 of the press roller 140 can rotate about the axial member 143. The body 141 of the press roller 140 is formed as a pipe. A coat layer 142 is formed on the outer circumferential surface of the body 141 in order to help the fusing roller 110 to be easily detached from the toner image after fusing the toner image onto the recording medium. In some cases, the fusing roller 110 may be formed to apply both heat and pressure to the recording medium, in which case, the press roller 140 is unnecessary.

The fusing roller 110 is composed of a heating roller 112, an induced coil 114, a compensator 130, and a power supply 150.

The heating roller 112 is formed of a resistive material as a pipe. The surface of the heating roller 112 is coated with a coat layer 111, which is formed of Teflon™ that helps the fusing roller 110 to be easily detached from the toner image fused onto the recording medium. The heating roller 112 is magnetized by a magnetic field and conducts current therethrough. The heating roller 112 may be formed of iron alloy, copper alloy, aluminium alloy, nickel alloy, or chrome alloy.

The induced coil 114 is arranged into a spiral on the inner surface of the heating roller 112 in firm contact with the inner surface of the heating-roller 112. The induced coil 114 generates an alternating magnetic flux, which varies depending on the intensity of current input from the power supply 150. The induced coil 114 may be formed of a copper-based ribbon coil. The induced coil 114 is coated with an insulation layer 113 and is firmly attached to the inner surface of the heating roller 12 by a heat-resistant adhesive 115.

Even when an alternating current is input to the induced coil 114, the insulation layer 113 is resistant to dielectric breakdown and prevents a leakage current from flowing along the induced coil 114 by insulating the induced coil 114. Given all this, the insulation layer 113 should have a high withstand voltage and high dielectric breakdown resistance. If the insulation layer 113 can endure a high power supply voltage supplied from outside the fusing roller 110, the insulation layer 113 is considered to have a high withstand voltage. If the insulation layer 113 generates a leakage current of less than 10 mA for one minute and does not break down dielectrically when a power supply voltage, which is not higher than the withstand voltage of the insulation layer 113, is applied to the fusing roller 110, the insulation layer 113 is considered to have high dielectric breakdown resistance. The insulation layer 113 may be formed of mica, polyimide, ceramic, silicon, polyurethane, glass, or polytetrafluoruethylene.

Both ends of the induced coil 114 are connected to a lead 116 so that the induced coil 114 can be electrically connected to the power supply 150.

When an alternating current is applied to the induced coil 114, the induced coil 114 generates an alternating magnetic flux, which generates an eddy current to the heating roller 112. Since the heating roller 112 has resistance, the heating roller 112 generates as much heat as the magnitude of the alternating current when the alternating current is applied thereto.

The compensator 130 is installed inside the heating roller 112 facing the induced coil 114. The compensator 130 compensates for the eddy current generated by the heating roller 112 by generating as much an eddy current as the alternating current received from the outside. Accordingly, portions of the heating roller 112 that face the compensator 130 do not generate heat because they do not generate an eddy current.

The compensator 130 may be a cylindrical bobbin 131 with a coil 132 wound therearound in a spiral. The compensator 130 may rotate together with the heating roller 112. For the convenience of illustration, a connection between the compensator 130 and an external power supply is not illustrated in FIGS. 3 through 6.

Due to the installment of the compensator 130 in the heating roller 112, it is possible to reduce the power consumption of the fusing roller 110 and enhance the durability of the fusing roller 110 by heating only as large an area as the recording medium, regardless of how small the recording medium is.

An end cap 120 and a driving force transferring end cap 121 are respectively formed at both ends of the heating roller 112. The driving force transferring end cap 121 is the same as the end cap 120 except that the driving force transferring end cap 121 includes a driving force transferring unit (not shown), such as a gear, which is connected to an electromotive apparatus (not shown) and rotates the fusing roller 110.

An air vent 122 is formed in the end cap 120. The air vent 122 allows air to come in and go out of an inner space 117 of the heating roller 122 so that the inner space 117 can be maintained at atmospheric pressure.

Therefore, even when the heating roller 112 is heated by heat transferred from the induced coil 114, the inner space 117 of the heating roller 112 can be maintained at atmospheric pressure because the air outside the inner space 117 keeps coming in the inner space 117 via the air vent 122. The air vent 122 may be formed at the driving force transferring end cap 121. Alternatively, the air vent 122 may be formed at both the end cap 120 and the driving force transferring end cap 121.

An electrode 123 is installed at each of the end cap 120 and the driving force transferring end cap 121. The electrode 123 is electrically connected to the lead 116. A current supplied from an external power supply (not shown) is transmitted to the induced coil 114 via the power supply 150, the electrode 123, and the lead 116.

Referring to FIG. 4, the power supply 150 includes a power supply portion 151, a line filtering portion 152, a rectifying portion 153, and a high frequency current generation portion 154.

The power supply portion 151 provides the line filtering portion 152 with an alternating current with a predetermined magnitude and frequency.

The line filtering unit 152 includes an inductor L and a capacitor C1 and removes high frequency components from the alternating current received from the power supply portion 151. In other words, the line filtering unit 152 smoothes the alternating current received from the power supply portion 151.

The rectifying portion 153 rectifies the alternating current, from which the high frequency components have already been removed by the line filtering unit 152, thereby generating a direct current. The rectifying portion 153 may be a bridge rectifier composed of four diodes D1, D2, D3, and D4 and rectifies an alternating current into a direct current based on the polarization of the four diodes D1, D2, D3, and D4.

The high frequency current generation portion 154 receives the direct current from the rectifying portion 153 and generates an alternating current with a high frequency based on the received direct current. The high frequency current generation portion 154 includes two capacitors C2 and C3 and two switches SW1 and SW2 and converts a direct current, obtained as a result of rectifying an alternating current, into an alternating current with a high frequency by turning on or off one or both of the switches SW1 or SW2. A low frequency current generation portion may be used instead of the high frequency current generation portion 154. The power supply 150 may have a different structure from the one set forth herein.

Compensating for heat, generated by the fusing roller 110, using the compensator 130 will now be described in further detail with reference to FIGS. 5 and 6.

Referring to FIGS. 5 and 6, when an alternating current is input from the power supply 150 to the induced coil 114, the induced coil 114 generates an alternating magnetic flux A, as marked by solid lines in FIG. 5. The alternating magnetic flux A generated by the induced coil 114 is interlinked with the heating roller 112. The variation of the alternating magnetic flux A causes eddy currents B and C to be generated in opposite directions.

Since the heating roller 112 has resistance, heat (hereinafter referred to as induced Joule heat G) is induced in the heating roller 112 by the eddy currents B and C. The induced Joule heat G is conducted to the toner image via the coat layer 111 by the heating roller 112.

Since the induced coil 114 also has resistance, heat (hereinafter referred to as resistive Joule heat H) is generated in the induced coil 114 in response to the alternating current input to the induced coil 114. The resistive Joule heat H is transmitted to the toner image via the insulation layer 113, the heat-resistant adhesive 115, the induced coil 114, and the coat layer 111.

In short, when the alternating current is supplied from the power supply 150 to the induced coil 114, the toner image is fused onto the recording medium by the resistive Joule heat H, generated in the induced coil 114 in response to the alternating magnetic flux input to the induced coil 114, and the induced Joule heat G, induced in the heating roller 112 by the eddy currents B and C.

When a current is input to the compensator 130 in a direction opposite to a direction in which a current is input to the induced coil 114, an alternating magnetic flux D is generated in an opposite direction to the alternating magnetic flux A, as marked by dotted lines in FIG. 5. Due to the alternating magnetic flux D, eddy currents E and F are generated in opposite directions. The eddy currents E and F are respectively in the opposite directions to the eddy currents B and C. Therefore, the eddy currents E and F respectively compensate for the eddy currents B and C, so the induced Joule heat G is not generated at the heating roller 112 that faces the compensator 130.

In short, the resistive Joule heat H is generated at portions L1 and L3 of the heating roller 112 that face the compensator 130, but the induced Joule heat G is not generated at the portions L1 and L3. Thus, the temperature of a portion L2 of the heating roller 112 that does not face the compensator 130 is lower than the temperatures of the portions L1 and L3 of the heating roller 112 that face the compensator 130 by as much the induced Joule heat G.

Figure 7:
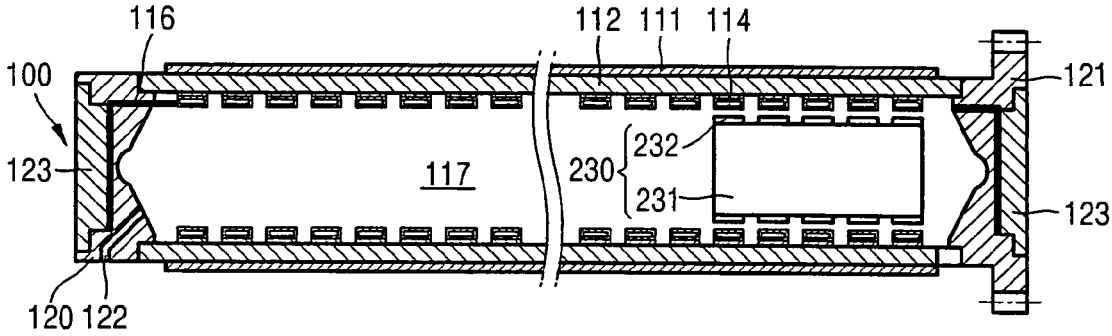
FIG. 7 is a latitudinal cross-sectional view of a fusing apparatus, in which a fusing roller according to another exemplary embodiment of the present invention is installed.

FIG. 7 is a latitudinal cross-sectional view of a fusing apparatus, in which a fusing roller according to another exemplary embodiment of the present invention is installed. Referring to FIG. 7, the fusing roller has the same structure as the fusing roller 110 of FIG. 3 except that a compensator 230 is installed inside a heating roller 112 facing only one end portion of an induced coil 114. The compensator 230 may be a cylindrical bobbin 231 with a coil 232 wound therearound in a spiral. Therefore, induced Joule heat G is not generated at portions of the heating roller 112 that face the compensator 230 such that the temperature of the heating roller 112 is lower at the portions facing the compensator 230 than at other portions not facing the compensator 230.

Figure 8:
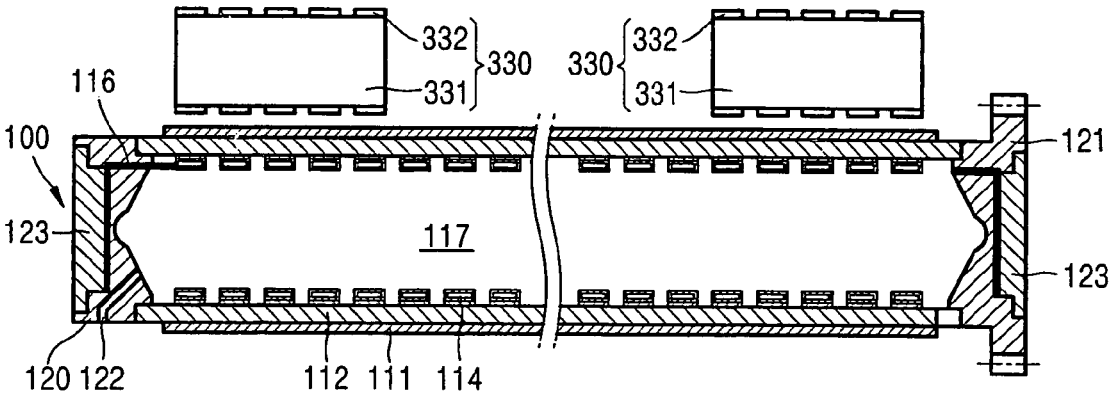
FIG. 8 is a latitudinal cross-sectional view of a fusing apparatus, in which a fusing roller according to yet another exemplary embodiment of the present invention is installed.

FIG. 8 is a latitudinal cross-sectional view of a fusing apparatus 100, in which a fusing roller according to yet another exemplary embodiment of the present invention is installed. Referring to FIG. 8, the fusing roller has the same structure as the fusing roller 110 of FIG. 3 except that a compensator 330 is installed at either end portion of an outer circumferential surface of a heating roller 112. The compensator 330 may be a cylindrical bobbin 331 with a coil 332 wound therearound in a spiral. Therefore, induced Joule heat G is not generated at portions of the heating roller 112 that face the compensator 330 such that the temperature of the heating roller 112 is lower at the portions facing the compensator 330 than at other portions not facing the compensator 330.

Figure 9:
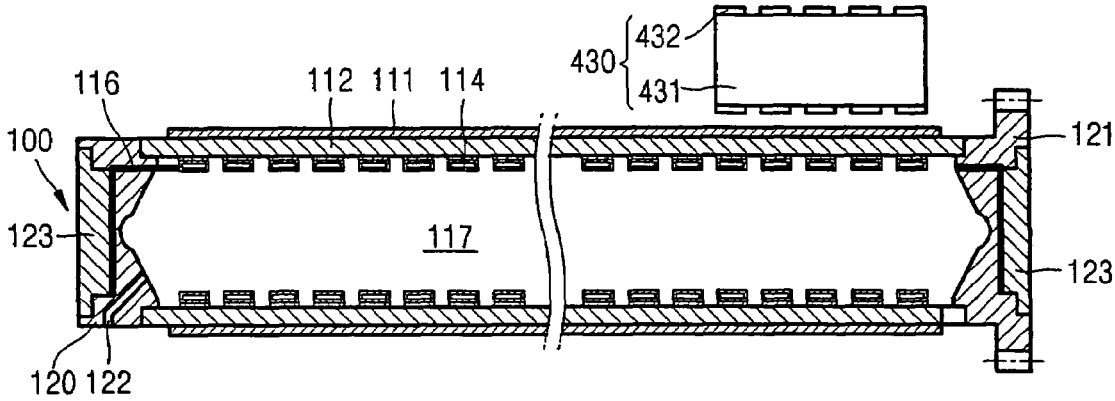
FIG. 9 is a latitudinal cross-sectional view of a fusing apparatus, in which a fusing roller according to still another exemplary embodiment of the present invention is installed.

FIG. 9 is a latitudinal cross-sectional view of a fusing apparatus 100, in which a fusing roller according to still another exemplary embodiment of the present invention is installed. Referring to FIG. 9, the fusing roller has the same structure as the fusing roller 110 of FIG. 3 except that a compensator 430 is installed at only one end portion of an outer circumferential surface of a heating roller 112. The compensator 430 may be a cylindrical bobbin 431 with a coil 432 wound therearound in a spiral. Therefore, induced Joule heat G is not generated at portions of the heating roller 112 that face the compensator 430 such that the temperature of the heating roller 112 is lower at the portions facing the compensator 130 than at other portions not facing the compensator 430.

As described above, the fusing roller according to the present invention and the fusing apparatus having the same have the following advantages.

First, since eddy currents, generated at a portion of the fusing apparatus that does not face a recording medium, are compensated for by using a compensator installed in the fusing roller, it is possible to prevent the temperature of the fusing roller from excessively increasing.

Next, since an induced coil is formed of a high dielectric material and is firmly attached to an inner surface of a heating roller by using a heat-resistant adhesive, it is possible to increase thermal efficiency of the fusing apparatus.

Finally, since the heating roller is heated by using resistive Joule heat and induced Joule heat together, it is possible to reduce the time required for warming the fusing apparatus up until the temperature of the fusing roller reaches a desired fusing temperature.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A fusing roller comprising:

an induced coil, which generates an alternating magnetic flux that varies depending on an input alternating current;

a heating roller, which is heated by an eddy current that is generated by the alternating magnetic flux; and a compensator, which compensates for the eddy current generated where it is located, wherein the induced coil is coated with an insulation layer, generates the alternating magnetic flux, and is firmly attached to an inner surface of the heating roller by an adhesive.

2. The fusing roller of claim 1, wherein the heating roller is heated by both resistive Joule heat, generated due to the resistance of the induced coil, and induced Joule heat generated due to the eddy current generated by the alternating magnetic flux.

3. The fusing roller of claim 1, wherein the compensator is located inside the heating roller facing either end portion of the induced coil.

4. The fusing roller of claim 3, wherein the compensator rotates together with the heating roller.

5. The fusing roller of claim 1, wherein the compensator is located inside the heating roller facing one end portion of the induced coil.

6. The fusing roller of claim 1, wherein the compensator is installed outside the heating roller facing one end portion of the induced coil.

7. The fusing roller of claim 1, further comprising:

a power supply, which generates an alternating current with a high frequency.

8. The fusing roller of claim 1, wherein the induced coil is formed of a copper based ribbon coil.

9. The fusing roller of claim 1, wherein the compensator comprises:

a cylindrical bobbin; and a coil wound around the cylindrical bobbin in a spiral.

10. A fusing roller comprising:

an induced coil, which generates an alternating magnetic flux that varies depending on an input alternating current;

a heating roller, which is heated by an eddy current that is generated by the alternating magnetic flux; and a compensator, which compensates for the eddy current generated where it is located, wherein the compensator is installed outside the heating roller facing either end portion of the induced coil.

11. The fusing roller of claim 10, wherein the compensator is fixed rather than rotating together with the heating roller.

12. A fusing apparatus comprising:

a fusing roller, which generates heat to fuse a toner image onto a recording medium; and a press roller, which is installed to face the fusing roller and presses the recording medium down on the fusing roller, wherein the fusing roller comprises:

an induced coil, which generates an alternating magnetic flux that varies depending on an input alternating current;

a heating roller, which is heated by an eddy current that is generated by the alternating magnetic flux; and a compensator, which compensates for the eddy current generated where it is located, wherein the heating roller is heated by both resistive Joule heat, generated due to the resistance of the induced coil, and induced Joule heat, generated due to the eddy current generated by the alternating magnetic flux.

13. The fusing roller of claim 12, wherein the induced coil is coated with an insulation layer, generates the alternating magnetic flux, and is firmly attached to an inner surface of the heating roller by an adhesive.

14. The fusing roller of claim 12, wherein the compensator is located inside the heating roller facing either end portion of the induced coil.

15. The fusing roller of claim 14, wherein the compensator rotates together with the heating roller.

16. The fusing roller of claim 12, wherein the compensator is located inside the heating roller facing one end portion of the induced coil.

17. The fusing roller of claim 12, wherein the compensator is installed outside the heating roller facing either end portion of the induced coil.

18. The fusing roller of claim 17, wherein the compensator is fixed rather than rotating together with the heating roller.

19. The fusing roller of claim 12 further comprising:

a power supply, which generates an alternating current with a high frequency.

20. The fusing roller of claim 12, wherein the induced coil is formed of a copper based ribbon coil.

21. A fusing apparatus comprising:

a fusing roller, which generates heat to fuse a toner image onto a recording medium; and a press roller, which is installed to face the fusing roller and presses the recording medium down on the fusing roller, wherein the fusing roller comprises:

an induced coil, which generates an alternating magnetic flux that varies depending on an input alternating current;

a heating roller, which is heated by an eddy current that is generated by the alternating magnetic flux; and a compensator, which compensates for the eddy current generated where it is located, wherein the compensator is installed outside the heating roller facing one end portion of the induced coil.

22. A fusing apparatus comprising:

a fusing roller, which generates heat to fuse a toner image onto a recording medium: and a press roller, which is installed to face the fusing roller and presses the recording medium down on the fusing roller, wherein the fusing roller comprises:

an induced coil, which generates an alternating magnetic flux that varies depending on an input alternating current;

a heating roller, which is heated by an eddy current that is generated by the alternating magnetic flux; and a compensator, which compensates for the eddy current generated where it is located, wherein the compensator comprises:

a cylindrical bobbin; and a coil wound around the cylindrical bobbin in a spiral.

* * * * *

UNITED STATES PATENT AND TRADEMARK OFFICE

CERTIFICATE OF CORRECTION

PATENT NO. : 7,369,802 B2
APPLICATION NO. : 11/178296
DATED : May 6, 2008
INVENTOR(S) : Durk-hyun Cho et al.

It is certified that error appears in the above-identified patent and that said Letters Patent is hereby corrected as shown below:

Title Page, Item [56] Column 2 (U.S. Patent Documents), Line 3, change “Suzki” to --Suzuki--.

Column 8, Line 7 claim 2, after “heat” insert --,--.

Column 10, Line 9 claim 22, change “medium:” to --medium;--.

Signed and Sealed this

Seventh Day of October, 2008

JON W. DUDAS
*Director of the United States Patent and Trademark Office*